US006543891B1

(12) United States Patent
Bermel et al.

(10) Patent No.: US 6,543,891 B1
(45) **Date of Patent: *Apr. 8, 2003**

(54) INK JET PRINTING METHOD

(75) Inventors: Alexandra D. Bermel, Pittsford, NY (US); Lori J. Shaw-Klein, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 99 days.

This patent is subject to a terminal disclaimer.

(21) Appl. No.: 09/770,433

(22) Filed: Jan. 26, 2001

(51) Int. Cl.[7] ..... B41J 2/01
(52) U.S. Cl. ..... 347/105; 428/195
(58) Field of Search ..... 428/195, 323, 428/327, 328, 329, 332, 342; 347/105, 106

(56) References Cited

U.S. PATENT DOCUMENTS 6,089,704 A 7/2000 Burns et al.
6,096,469 A 8/2000 Anderson et al.
6,187,430 B1 * 2/2001 Mukoyoshi et al. ..... 428/331
6,326,075 B1 * 12/2001 Nagasaki et al. ..... 428/195
6,403,162 B1 * 6/2002 Tokunaga et al. ..... 427/379
2001/0004487 A1 * 6/2001 Kaneko et al. ..... 428/195

FOREIGN PATENT DOCUMENTS

EP 1 002 660 A1 5/2000

* cited by examiner

*Primary Examiner*—Bruce H. Hess
*Assistant Examiner*—Michael E. Grendzynski
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with an ink jet recording element comprising a support having thereon a porous image-receiving layer comprising:

(a) particles having a primary particle size of from about 7 to about 40 nm in diameter which may be aggregated up to about 300 nm; and (b) water insoluble, cationic, polymeric particles comprising at least about 20 mole percent of a cationic mordant moiety;

C) loading the printer with an ink jet ink composition; and

D) printing on the image-receiving layer using the ink jet ink composition in response to the digital data signals.

15 Claims, No Drawings

INK JET PRINTING METHOD

CROSS REFERENCE TO RELATED APPLICATIONS

Reference is made to commonly assigned, co-pending U.S. Patent Applications:

Ser. No. 09/770,814 by Bermel et al., filed Jan. 26, 2001 entitled "Ink Jet Recording Element";
Ser. No. 09/771,191 by Bermel et al., filed Jan. 26, 2001 entitled "Ink Jet Recording Element";
Ser. No. 09/770,429 by Bermel et al., filed Jan. 26, 2001 entitled "Ink Jet Recording Element";
Ser. No. 09/771,189 by Bermel et al., filed Jan. 26, 2001 entitled "Ink Jet Printing Method";
Ser. No. 09/770,807 by Bermel et al., filed Jan. 26, 2001 entitled "Ink Jet Printing Method";
Ser. No. 09/770,728 by Bermel et al., filed Jan. 26, 2001 entitled "Ink Jet Printing Method";
Ser. No. 09/770,128 by Lawrence et al., filed Jan. 26, 2001 entitled "Ink Jet Printing Method";
Ser. No. 09/770,127 by Lawrence et al., filed Jan. 26, 2001 entitled "Ink Jet Printing Method";
Ser. No. 09/770,781 by Lawrence et al., filed Jan. 26, 2001 entitled "Ink Jet Printing Method";
Ser. No. 09/771,251 by Lawrence et al., filed Jan. 26, 2001 entitled "Ink Jet Printing Method";
Ser. No. 09/770,122 by Lawrence et al., filed Jan. 26, 2001 entitled "Ink Jet Printing Method";
Ser. No. 09/772,097 by Lawrence et al., filed Jan. 26, 2001 entitled "Ink Jet Printing Method";
Ser. No. 09/772,782 by Lawrence et al., filed Jan. 26, 2001 entitled "Ink Jet Recording Element"; and
Ser. No. 09/770,431 by Lawrence et al., filed Jan. 26, 2001 entitled "Ink Jet Printing Method".

FIELD OF THE INVENTION

The present invention relates to a method for using a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer.

EP 1,002,660 relates to a porous ink jet recording element comprising fine particles, hydrophilic binder and a water-soluble, cationic polymer. However, there is a problem with this element in that the density of an image printed on such an element using a water-soluble cationic polymer is lower than one would like.

U.S. Pat. No. 6,089,704 relates to a nonporous ink jet recording element comprising cationic polymeric vinyl latex and a hydrophilic polymer. However, there is a problem with this nonporous recording element in that it images printed thereon dry too slowly.

U.S. Pat. No. 6,096,469 relates to an ink jet recording element comprising mesoporous particles dispersed in an organic binder. In column 8, it is disclosed that the organic binder can be a cationic latex polymer "having less than 10 mole percent of a copolymerizable monomer having a tertamino or quaternary ammonium functionality." However, there is a problem with this element in that the density of an image printed on such an element with a binder having less than 10 mole percent of a cationic mordant functionality is lower than one would like.

It is an object of this invention to provide a method for using a porous ink jet recording element that, when printed with dye-based inks, provides superior optical densities, good image quality and has an excellent dry time.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an ink jet recording element comprising a support having thereon a porous image-receiving layer comprising:
   (a) particles having a primary particle size of from about 7 to about 40 nm in diameter which may be aggregated up to about 300 nm; and
   (b) water insoluble, cationic, polymeric particles comprising at least about 20 mole percent of a cationic mordant moiety;

C) loading the printer with an ink jet ink composition; and

D) printing on the image-receiving layer using the ink jet ink composition in response to the digital data signals.

By use of the process of the invention, a porous ink jet recording element is obtained that, when printed with dye-based inks, provides superior optical densities, good image quality and has an excellent dry time.

DETAILED DESCRIPTION OF THE INVENTION

Examples of (a) particles useful in the invention include alumina, boehmite, clay, calcium carbonate, titanium dioxide, calcined clay, aluminosilicates, silica, barium sulfate, or polymeric beads. The particles may be porous or nonporous. In a preferred embodiment of the invention, the particles are metallic oxides, preferably fumed. While many types of inorganic and organic particles are manufactured by various methods and commercially available for an image-receiving layer, porosity of the ink-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small that they do not scatter visible light.

The (a) particles may be in the form of primary particles, or in the form of secondary aggregated particles. The aggregates are comprised of smaller primary particles about 7 to about 40 nm in diameter, and being aggregated up to about 300 nm in diameter. The pores in a dried coating of such aggregates fall within the range necessary to ensure low optical scatter yet sufficient ink solvent uptake.

Preferred examples of fumed metallic oxides which may be used in the invention as the (a) particles include silica and alumina fumed oxides. Fumed oxides are available in dry form or as dispersions of the aggregates mentioned above.

The (b) water insoluble, cationic, polymeric particles comprising at least about 20 mole percent of a cationic mordant moiety useful in the invention can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyper-branched, grafted, random, blocked, or can have other polymer microstructures well known to those in the art. They also can be partially crosslinked. Examples of core/shell particles useful in the invention are disclosed and claimed in U.S. patent application Ser. No. 09/772,097, of Lawrence et al., Ink Jet Printing Method, filed Jan. 26, 2001, the disclosure of which is hereby incorporated by reference. Examples of water dispersible particles useful in the invention are disclosed and claimed in U.S. patent application Ser. No. 09/770,128, of Lawrence et al., Ink Jet Printing Method, filed Jan. 26, 2001; and U.S. patent application Ser. No. 09/770,127, of Lawrence et al., Ink Jet Printing Method, filed Jan. 26, 2001, the disclosures of which are hereby incorporated by reference. In a preferred embodiment, the water insoluble, cationic, polymeric particles comprise at least about 50 mole percent of a cationic mordant moiety.

The (b) water insoluble, cationic, polymeric particles useful in the invention can be derived from nonionic, anionic, or cationic monomers. In a preferred embodiment, combinations of nonionic and cationic monomers are employed. In general, the amount of cationic monomer employed in the combination is at least about 20 mole percent.

The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters, vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitrites, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

The (b) water insoluble, cationic, polymeric particles employed in this invention can be prepared using conventional polymerization techniques including, but not limited to bulk, solution, emulsion, or suspension polymerization.

The amount of (b) water insoluble, cationic, polymeric particles used should be high enough so that the images printed on the recording element will have a sufficiently high density, but low enough so that the interconnected pore structure formed by the aggregates is not filled. In a preferred embodiment of the invention, the weight ratio of (b) water insoluble, cationic, polymeric particles to (a) particles is from about 1:2 to about 1: 10, preferably about 1:5.

Examples of (b) water insoluble, cationic, polymeric particles which may be used in the invention include those described in U.S. Pat. No. 3,958,995, the disclosure of which is hereby incorporated by reference. Specific examples of these polymers include:

Polymer A. Copolymer of (vinylbenzyl) trimethylammonium chloride and divinylbenzene (87:13 molar ratio)

Polymer B. Terpolymer of styrene, (vinylbenzyl) dimethylbenzylarnine and divinylbenzene (49.5:49.5: 1.0 molar ratio)

Polymer C. Terpolymer of butyl acrylate, 2-aminoethylmethacrylate hydrochloride and hydroxyethylmethacrylate (50:20:30 molar ratio)

Polymer D. Copolymer of styrene, dimethylacrylamide, vinylbenzylimidazole and 1-vinylbenzyl-3-hydroxyethylimidazolium chloride (40:30:10:20 molar ratio)

Polymer E. Copolymer of styrene, 4-vinylpyridine and N-(2-hydroxyethyl)-4-vinylpyridinium chloride (30:38:32 molar ratio)

Polymer F. Copolymer of styrene, (vinylbenzyl) dimethyloctylammonium chloride), isobutoxymethyl acrylamide and divinylbenzene (40:20:34:6 molar ratio)

In a preferred embodiment of the invention, the image-receiving layer also contains a polymeric binder in an amount insufficient to alter the porosity of the porous receiving layer. In another preferred embodiment, the polymeric binder is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, gelatin, or a poly(alkylene oxide). In yet still another preferred embodiment, the hydrophilic binder is poly(vinyl alcohol). The polymeric binder should be chosen so that it is compatible with the aforementioned particles.

The amount of binder used should be sufficient to impart cohesive strength to the ink jet recording element, but should also be minimized so that the interconnected pore structure formed by the aggregates is not filled in by the binder. In a preferred embodiment of the invention, the weight ratio of the binder to the total amount of particles is from about 1:20 to about 1:5.

In addition to the image-receiving layer, the recording element may also contain a base layer, next to the support, the function of which is to absorb the solvent from the ink. Materials useful for this layer include (a) particles, (b) particles, polymeric binder and/or crosslinker.

Since the image-receiving layer is a porous layer comprising particles, the void volume must be sufficient to absorb all of the printing ink. For example, if a porous layer has 60 volume % open pores, in order to instantly absorb 32 $cc/m^2$ of ink, it must have a physical thickness of at least about 54 1 $\mu$m.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements used in the present invention are well-known in the art. The ink compositions used in ink jet printing typically are liquid compositions comprising a solvent or carrier liquid, a colorant such as a dye or pigment, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference. In a preferred embodiment of the invention, the colorant is a water-soluble anionic dye. Examples of such dyes are found, for example, in Ser. No. 09/770,128 by Lawrence et al., filed of even date herewith entitled "Ink Jet Printing Method", the disclosure of which is hereby incorporated by reference.

The following example is provided to illustrate the invention.

EXAMPLE

The following comparative cationic polymers used are water-soluble:

C-1 Poly(vinylbenzyl)trimethylammonium chloride, available as Chemistat® 6300H from Sanyo Chemical Industries.

C-2 Poly(3-N,N,N-trimethyl)propyl methacrylamide chloride, available as Polycare® 133 from Rhone-Poulenc Co.

C-3 Polypropylene oxide-based triamine, available as Jeffamine® T-5000 from Huntsman, Corp.

C-4 Polyethylene polyamine resin, available as Niccajet® 117 from Nicca, USA.

C-5 Polyethyleneimine, available as Lupasol® PEI from BASF Corp.

C-6 Poly(diallyldimethylammonium chloride), available as Merquat® 100 from Calgon Corp.

C-7 Poly[N-[3-(dimethylamino)propyl]-N'-[3-ethyleneoxyethylene dimethylammonio)propyl]urea dichloride], available as Mirapol® WT from Rhone-Poulenc Co.

The following comparative (b) cationic particles used are inorganic and water insoluble:

C-8 Inorganic dispersion of alumina coated colloidal silica, available as Ludox® CL from E.I. du Pont de Nemours and Co.

The following comparative (b) water insoluble, cationic, polymeric articles used have less than 20 mole percent of a cationic mordant moiety:

C-9 Copolymer of butyl acrylate, 2-aminoethylmethacrylate hydrochloride and hydroxyethylmethacrylate (70/5/25 molar ratio)

Element 1 of the Invention

A coating solution for a base layer was prepared by combining fumed alumina (Cab-O-Sperse® PG003, Cabot Corp.), poly(vinyl alcohol) (Gohsenol® GH-23A, Nippon Gohsei Co., Ltd.) and 2,3-dihydroxy-1,4-dioxane (Clariant Corp.) in a ratio of 88:10:2 to give an aqueous coating formulation of 30% solids by weight.

A coating solution for an image-receiving layer was prepared by combining fumed alumina (Cab-O-Sperse® PG003, Cabot Corp.), poly(vinyl alcohol) (Gohsenol® GH-23A, Nippon Gohsei Co.) and Polymer A in a ratio of 85:3:12 to give an aqueous coating formulation of 10% solids by weight. The fumed alumina particles have a primary particle size of from about 7 to about 40 nm in diameter and are aggregated up to about 150 nm. Surfactants Zonyl® FSN (E.I. du Pont de Nemours and Co.) and Olin® 10G (Dixie Chemical Co.) were added in small amounts as coating aids.

The above coating solutions were simultaneously bead-coated at 40° C. on polyethylene-coated paper base which had been previously subjected to corona discharge treatment. The image-receiving layer was coated on top of the base layer. The coating was then dried at 60° C. by forced air to yield a two-layer recording element in which the thicknesses of the bottom and topmost layers were 40 $\mu$m (43 g/m$^2$) and 2 $\mu$m (2.2 g/m$^2$), respectively.

Element 2 of the Invention

Element 2 was prepared the same as Element 1 except that Polymer B was used instead of Polymer A.

Element 3 of the Invention

Element 3 was prepared the same as Element 1 except that the ratio for the image-receiving layer was 73:6:21 for fumed alumina to poly(vinyl alcohol) to Polymer A.

Comparative Element 1

This element was prepared the same as Element 1 except that Polymer C-1 was used instead of Polymer A.

Comparative Element 2

This element was prepared the same as Element 1 except that Polymer C-2 was used instead of Polymer A.

Comparative Element 3

This element was prepared the same as Element 1 except that Polymer C-3 was used instead of Polymer A.

Comparative Element 4

This element was prepared the same as Element 1 except that Polymer C-4 was used instead of Polymer A.

Comparative Element 5

This element was prepared the same as Element 1 except that Polymer C-5 was used instead of Polymer A.

Comparative Element 6

This element was prepared the same as Element 1 except that Polymer C-6 was used instead of Polymer A.

Comparative Element 7

This element was prepared the same as Element 1 except that Polymer C-7 was used instead of Polymer A.

Comparative Element 8

This element was prepared the same as Element 1 except that Polymer C-8 was used instead of Polymer A.

Comparative Element 9

This element was prepared the same as Element 1 except that the image-receiving layer contained only fumed alumina.

Comparative Element 10

This element was prepared the same as Element 1 except that the image-receiving layer contained only fumed alumina and poly(vinyl alcohol) in a ratio of 98:2.

Comparative Element 11

This element was prepared the same as Comparative Element 10 except that the ratio of fumed alumina to poly(vinyl alcohol) was 90:10.

Comparative Element 12

This element was prepared the same as Element 3 except that Polymer C-9 was used instead of Polymer A.

Density Testing

Test images of cyan, magenta, yellow, red, green and blue patches at 100% ink laydown were printed using an Epson Stylus® Color 740 using inks with catalogue number S020191 or an Epson Stylus® Photo 870 using inks with catalogue number T008201.

After drying for 24 hours at ambient temperature and humidity, the Status A D-max densities were measured using an X-Rite® 820 densitometer as follows (for each of the red, green and blue densities, the two component color densities were measured and averaged):

TABLE 1

| Recording | Epson Stylus ® Color 740 Status A D-max Density | | | | | |
|---|---|---|---|---|---|---|
| Element | Cyan | Magenta | Yellow | Red | Green | Blue |
| 1 | 2.24 | 1.86 | 1.65 | 1.65 | 1.96 | 2.01 |
| 2 | 2.01 | 1.75 | 1.58 | 1.55 | 1.80 | 1.79 |
| C-1 | 2.07 | 1.39 | 1.29 | 1.17 | 1.55 | 1.63 |
| C-2 | 1.52 | 1.04 | 1.08 | 0.85 | 1.17 | 1.22 |
| C-3 | 1.98 | 1.45 | 1.21 | 1.22 | 1.50 | 1.53 |
| C-4 | 1.99 | 1.57 | 1.31 | 1.38 | 1.72 | 1.76 |
| C-8 | 1.99 | 1.47 | 1.25 | 1.19 | 1.51 | 1.55 |
| 3 | 2.09 | 1.83 | 1.59 | NA | NA | NA |
| C-12 | 1.44 | 1.18 | 1.17 | NA | NA | NA |

TABLE 2

| Recording | Epson Stylus ® Photo 870 Status A D-max Density | | | | | |
|---|---|---|---|---|---|---|
| Element | Cyan | Magenta | Yellow | Red | Green | Blue |
| 1 | 2.14 | 1.74 | 1.45 | 1.50 | 1.62 | 1.84 |
| C-5 | 1.69 | 1.74 | 1.47 | 1.23 | 1.33 | 1.47 |
| C-6 | 1.43 | 1.50 | 1.22 | 1.06 | 1.23 | 1.33 |
| C-7 | 1.69 | 1.73 | 1.34 | 1.12 | 1.24 | 1.38 |
| C-9 | 1.98 | 2.02 | 1.48 | 1.25 | 1.38 | 1.57 |
| C-10 | 1.98 | 2.01 | 1.52 | 1.24 | 1.44 | 1.55 |
| C-11 | 1.79 | 1.88 | 1.43 | 1.23 | 1.35 | 1.52 |

The above results show that print densities are higher in most colors for the recording elements employed in the invention as compared to the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet printing method, comprising the steps of:

A) providing an ink jet printer that is responsive to digital data signals;

B) loading the printer with an ink jet recording element comprising a support having thereon a porous image-receiving layer comprising:

(a) fumed alumina particles having a primary particle size of from about 7 to about 40 nm in diameter which may be aggregated up to about 300 nm; and (b) water insoluble, cationic, polymeric particles comprising at least 20 mole percent of a cationic mordant moiety;

C) loading said printer with an ink jet ink composition; and

D) printing on said image-receiving layer using said ink jet ink composition in response to said digital data signals.

2. The method of claim 1 wherein the weight ratio of (b) water insoluble, cationic, polymeric particles to (a) particles is from about 1:2 to about 1:10.

3. The method of claim 1 wherein the weight ratio of said binder to the total amount of particles is from about 1:20 to about 1:5.

4. The method of claim 1 wherein said polymeric binder is a hydrophilic polymer.

5. The method of claim 4 wherein said hydrophilic polymer is poly(vinyl alcohol), hydroxypropyl cellulose, hydroxypropyl methyl cellulose, gelatin, or a poly(alkylene oxide).

6. The method of claim 1 wherein said polymeric binder is poly(vinyl alcohol).

7. The method of claim 1 wherein said water insoluble, cationic, polymeric particles are in the form of a latex.

8. The method of claim 7 wherein said latex is a copolymer of (vinylbenzyl)trimethylammonium chloride and divinylbenzene in a 87:13 molar ratio.

9. The method of claim 7 wherein said latex is a terpolymer of styrene, (vinylbenzyl)dimethylbenzylamine and divinylbenzene in a 49.5:49.5:1.0 molar ratio.

10. The method of claim 1 wherein said water insoluble, cationic, polymeric particles are in the form of a water dispersible polymer.

11. The method of claim 1 wherein said image-receiving layer also contains a crosslinker capable of crosslinking said binder.

12. The method of claim 1 wherein said support is polyethylene-coated paper.

13. The method of claim 1 which also includes a base layer located between said image-receiving layer and said support.

14. The method of claim 1 wherein said water insoluble, cationic, polymeric particles comprise at least 50 mole percent of a cationic mordant moiety.

15. The method of claim 1 wherein said ink jet ink composition contains a water-soluble anionic dye.

* * * * *